US006982590B2

(12) United States Patent
Seshita

(10) Patent No.: US 6,982,590 B2
(45) Date of Patent: Jan. 3, 2006

(54) BIAS CURRENT GENERATING CIRCUIT, LASER DIODE DRIVING CIRCUIT, AND OPTICAL COMMUNICATION TRANSMITTER

(75) Inventor: Toshiki Seshita, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 105 days.

(21) Appl. No.: 10/779,653

(22) Filed: Feb. 18, 2004

(65) Prior Publication Data

US 2005/0104652 A1 May 19, 2005

(30) Foreign Application Priority Data

Apr. 28, 2003 (JP) ..... 2003-124034

(51) Int. Cl.
*G05F 1/10* (2006.01)

(52) U.S. Cl. ..... 327/539; 327/541

(58) Field of Classification Search ..... 327/538, 327/539, 540, 541, 542; 323/313, 315
See application file for complete search history.

(56) References Cited

U.S. PATENT DOCUMENTS 5,109,187 A * 4/1992 Guliani ..... 365/185.21
5,631,600 A * 5/1997 Akioka et al. ..... 327/543
5,774,013 A * 6/1998 Groe ..... 327/543
2004/0207379 A1 * 10/2004 Camara et al. ..... 323/313

FOREIGN PATENT DOCUMENTS

JP 2000-224250 9/2000

OTHER PUBLICATIONS

Maxim Printed Data Sheet (19-2194; Rev. 1; Rev. Mar. 25, 2002), 17 pages http://www.maxim-ic.com/quick-view2.cfm/qv-pk/3165.

* cited by examiner

*Primary Examiner*—Terry D. Cunningham
(74) *Attorney, Agent, or Firm*—Oblon, Spivak, McClelland, Maier & Neustadt, P.C.

(57) ABSTRACT

A bias current generating circuit including a bandgap reference circuit which outputs a first voltage which is constant, and a second voltage which changes in accordance with a temperature. The generating circuit also includes a first low-potential-side constant-current source circuit which receives the second voltage, and outputs a first electric current dependent on a temperature, and a second low-potential side constant-current source circuit which receives the first voltage, and outputs a second electric current independent of a temperature. A third low-potential-side constant-current source circuit in the generating circuit receives the first voltage, and supplies a third temperature-independent current. A high-potential-side constant-current source circuit receives a third voltage and outputs a fourth electric current independent of a temperature. A current mirror circuit then generates a bias current in accordance with an electric current supplied from a reference current terminal to which the first, second and third supply terminals are connected.

16 Claims, 7 Drawing Sheets

BIAS CURRENT GENERATING CIRCUIT, LASER DIODE DRIVING CIRCUIT, AND OPTICAL COMMUNICATION TRANSMITTER

CROSS REFERENCE TO RELATED APPLICATION

This application is based upon and claims benefit of priority under 35 USC 119 from the Japanese Patent Application No. 2003-124034, filed on Apr. 28, 2003, the entire contents of which are incorporated herein by reference.

BACKGROUND OF THE INVENTION

The present invention relates to a bias current generating circuit, laser diode driving circuit, and optical communication transmitter.

A circuit for driving a laser diode amplifies a high-speed digital signal output from a time multiplexing circuit called a serializer or multiplexer, and outputs a driving current necessary to drive the laser diode.

This laser diode driving circuit is required not only to amplify a high-speed signal but also to supply a temperature-dependent driving current.

Generally, when the temperature rises, a laser diode increases an emission threshold current and its emission efficiency lowers. The emission threshold current is the value of a driving current for starting light emission. The emission efficiency is the value obtained by differentiating the optical output signal power amplitude by the driving current.

The increase in emission threshold current is suppressed by controlling the current value of a bias current generating circuit installed separately from a high-speed-signal processing amplifier in the laser diode driving circuit. This control is to receive an output current from a monitoring photodiode formed close to the laser diode, and adjust the bias current in accordance with the current value.

A direct current generated by this bias current generator determines the average emission power of the laser diode. The monitoring photodiode senses this average emission power, and the signal is returned to the bias current generator. By this negative feedback path, the average emission power can be controlled independently of the temperature.

A method of compensating for the decrease in emission efficiency caused by the temperature rise of the laser diode will be explained below.

FIG. 5 shows the arrangement of a high-speed-signal amplifier of the laser diode driving circuit. This high-speed-signal amplifier has a driving current controller 1, differential output unit 2, and differential amplifier DA100 as a driving stage.

A pair of differential signals are input to a non-inverting input terminal IN+ and inverting input terminal IN− of the differential amplifier DA100. Through this driver stage, the signals are input to the differential output unit 2 as a final amplification stage and output from it.

The differential output unit 2 is a differential circuit ECL (Emitter Coupled Logic) including bipolar transistors Q200 and Q201. However, the differential output unit 2 can also be constructed using FETs such as MESFETs or MOSFETs, instead of bipolar transistors.

The differential output unit 2 includes resistors R100 and R101, the bipolar transistors Q200 and Q201 making a differential pair, and a bipolar transistor Q202 as a current source transistor.

A bias current to be supplied to the base of the bipolar transistor Q202 is controlled by the driving current controller 1. Although the emitter of the bipolar transistor Q202 is directly grounded in FIG. 5, this emitter may also be grounded via a resistor.

The driving current controller 1 has a bias-current generating circuit BGC1 for generating a bias current Ibias, and bipolar transistors Q100 and Q101, and forms a current mirror circuit together with the transistor Q202 of the differential output unit 2.

The bias current Ibias generated by the bias current generating circuit BGC1 must be preset so as to rise at a desired ratio when the temperature rises, in order to meet the characteristics of the laser diode.

The conventional bias current generating circuit will be described below with reference to FIG. 6.

This bias current generating circuit comprises a bandgap reference circuit BGRC, low-potential-side, constant-current source circuits LCS1 and LCS2, and a current mirror circuit. The bandgap reference circuit BGRC includes resistors R1, R2, R3, and R4, NPN transistors Q1 and Q2, an N-channel transistor N1, and an operational amplifier OP1. The low-potential-side, constant-current source circuit LCS1 includes an N-channel transistor N3, operational amplifier OP4, external terminal PAD1, and external resistor R7. The low-potential-side, constant-current source circuit LCS2 includes an N-channel transistor N4, operational amplifier OP5, external terminal PAD2, and external resistor R9. The current mirror circuit includes P-channel transistors P2 and P3.

The parameters of the resistors R1, R2, R3, and R4, NPN transistors Q1 and Q2, N-channel transistor N1, and operational amplifier OP1 are so set that the circuit including these elements operates as the bandgap reference circuit BGRC.

Accordingly, an output potential V2 from the operational amplifier OP1 maintains about 1.2 V independently of the temperature and a power supply voltage Vcc. In contrast to the potential V2, a contact potential V1 proportional to absolute temperature is generated from the connection node between the resistors R3 and R4. At room temperature, the potential V1 is half (about 0.6 V) the potential V2.

The NPN transistor N1 forms a startup circuit controlled by an activation signal Startup which momentarily changes to high level when the power supply is turned on and then rapidly goes to a ground potential Vss. The NPN transistor N1 allows the bandgap reference circuit BGRC to reach a desired operating point immediately after the power supply is turned on.

Two constant-current source circuits which use the two potentials V1 and V2 generated by the bandgap reference circuit BGRC as reference potentials generate electric currents I1 and I2, respectively.

That is, a first constant-current source circuit including the operational amplifier OP4, NPN transistor N3, and resistor R7 generates the electric current I1 (= V1/R7), and a second constant-current source circuit including the operational amplifier OP5, NPN transistor N4, and resistor R9 generates the electric current I2 (= V2/R9). The resistor R7 is connected between the external terminal PAD1 and ground voltage Vss, and the resistor R9 is connected between the external terminal PAD2 and ground voltage Vss. The resistors R7 and R9 are formed outside a semiconductor integrated circuit forming the laser diode driving circuit, and implemented by fixed resistors, variable resistors, electronic volume ICs, or the like.

The electric currents I1 and I2 are added to form an electric current 13 which functions as a reference current of the current mirror circuit formed by the two PMOS transistors P2 and P3. As a consequence, the bias current Ibias amplified by the gate width ratio (M) of the PMOS transistor P3 to the PMOS transistor P2 is output as a mirror current. This bias current Ibias is the bias current Ibias finally output from the bias current generating circuit BGC1 in the driving current controller 1 shown in FIG. 5. The transistors Q100, Q101, and Q202 form a current mirror. The collector current of the transistor Q202 of the differential output unit 2 is the value obtained by multiplying the size ratio of Q202 to Q101 by the reference current IIbias. Consequently, the laser diode driving current amplitude is proportional to the reference current Ibias.

From the foregoing, letting T denote absolute temperature, Ibias is represented by $$\begin{aligned} Ibias &= M \times I3 \\ &= M \times (I1 + I2) \\ &= M \times \{(V1/R7) + (V2/R9)\} \\ &= M \times \{A \times T + B\} \end{aligned} \tag{1}$$

where A and B are constants and represented by $$A \cong (0.002/R7) \times T \tag{2}$$

$$B \cong 1.2/R9 \tag{3}$$

FIG. 7 shows an example of the temperature dependence of each of the electric currents I1, I2, and I3.

The ratio of the electric current I1 to the electric current I2 can be changed by the values of the resistors R7 and R9. When the ratio of the electric current I2 is raised, the temperature dependence of the bias current Ibias decreases. When the ratio of the electric current I1 is raised, the temperature dependence of the bias current Ibias increases.

As described above, by adjusting the values of the external resistors R7 and R9 in accordance with the temperature dependence of the emission efficiency of each individual laser diode, the optical output amplitude of the laser diode can be held constant regardless of the temperature.

The bias current Ibias of the bias current generating circuit shown in FIG. 6 becomes zero at absolute zero, when the resistor R9 is made infinite, i.e., when the resistor R9 is removed. That is, this bias current generating circuit has characteristics proportional to the temperature.

If the bias current Ibias at a certain temperature To is regarded as a reference, the rate of increase of the bias current Ibias per degree of the temperature is 1/To. If the temperature To is room temperature (300K), the rate of change of the bias current Ibias to the temperature is $1/300 \cong 3333$PPM.

Generally, the temperature dependence of the emission efficiency of a laser diode is larger than 3333PPM. The laser diode driving circuit having the bias current generating circuit shown in FIG. 6 cannot perform temperature compensation for such a laser diode. Accordingly, no optical signal power amplitude independent of the temperature can be obtained.

The following is a reference disclosing the conventional current control technique.

Japanese Patent Laid-Open No. 2000-244250.

As described above, the conventional bias current generating circuit cannot well perform temperature compensation for the temperature dependence of the emission efficiency of a laser diode.

SUMMARY OF THE INVENTION

According to one aspect of the present invention, there is provided a bias current generating circuit comprising, a bandgap reference circuit connected to a high power supply voltage terminal for receiving a high power supply voltage and a low power supply voltage terminal for receiving a low power supply voltage, and having a first output terminal for outputting a first voltage which is constant regardless of a temperature, and a second output terminal for outputting a second voltage which changes in accordance with a temperature;

a first low-potential-side constant-current source circuit which includes a first resistor connected between said low power supply voltage terminal and a first terminal, and a first current path connected between said first terminal and a first current supply terminal, receives the second voltage as a reference potential, and outputs a first electric current dependent on a temperature and corresponding to said first resistor from said first current supply terminal;

a second low-potential-side constant-current source circuit which includes a second resistor connected between said low power supply voltage terminal and a second terminal, and a second current path connected between said second terminal and a second current supply terminal, receives the first voltage as a reference potential, and outputs a second electric current independent of a temperature and corresponding to said second resistor from said second current supply terminal;

a third resistor having one end connected to said high power supply voltage terminal;

a third low-potential-side constant-current source circuit which is connected between the other end of said third resistor and said low power supply voltage terminal, receives the first voltage as a reference potential, and supplies a temperature-independent third electric current to said third resistor;

a high-potential-side constant-current source circuit which includes a fourth resistor connected between said high power supply voltage terminal and a third terminal, and a third current path connected between said third terminal and a third current supply terminal, receives a third voltage at the other end of said third resistor as a reference potential, and outputs a fourth electric current independent of a temperature and corresponding to said fourth resistor from said third current supply terminal; and a current mirror circuit which is connected to said high power supply voltage terminal to receive the high power supply voltage, and generates a bias current in accordance with an electric current supplied from a reference current terminal, wherein said first, second, and third current supply terminals are connected to said reference current terminal.

According to one aspect of the present invention, there is provided a laser diode driving circuit comprising, a sixth resistor having one end connected to said high power supply voltage terminal;

a fourth NPN bipolar transistor having a collector connected to the other end of said sixth resistor, and a base which receives one differential input signal;

a seventh resistor having one end connected to said high power supply voltage terminal;

a fifth NPN bipolar transistor having a collector connected to the other end of said seventh resistor, and a base which receives the other differential input signal;

a sixth NPN bipolar transistor having a collector connected to emitters of said fourth and fifth NPN bipolar transistors, a base connected to a current input terminal, and an emitter which is grounded either directly or via an eighth resistor;

a differential output unit which performs differential amplification by receiving the differential output signals, and generates a driving current signal for driving a laser diode from the collector of at least one of said fourth and fifth NPN bipolar transistors;

said bias current generating circuit; and a driving current controller which receives the bias current generated by said bias current generating circuit, amplifies the received bias current, and supplies the amplified bias current to the current input terminal of said differential output unit.

According to one aspect of the present invention, there is provided an optical communication transmitter comprising, said laser diode driving circuit; and a laser diode which receives the driving current signal generated by said laser diode driving circuit.

DESCRIPTION OF THE PREFERRED EMBODIMENT

An embodiment of the present invention will be described below with reference to the accompanying drawings.

Figure 1:
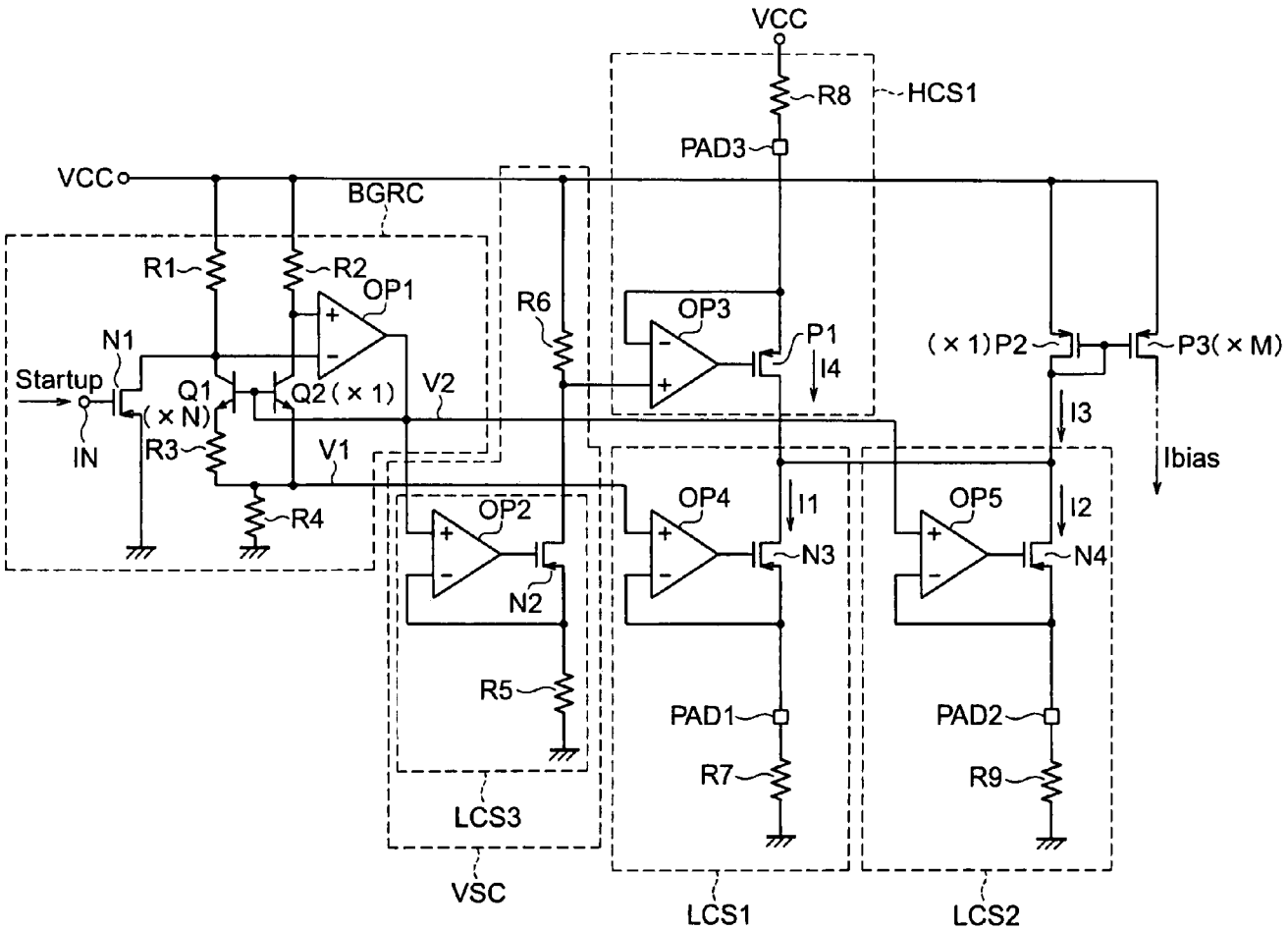
FIG. 1 is a circuit diagram showing the arrangement of a bias current generating circuit according to an embodiment of the present invention.

FIG. 1 shows the arrangement of a bias current generating circuit according to the embodiment of the present invention.

Figure 2:
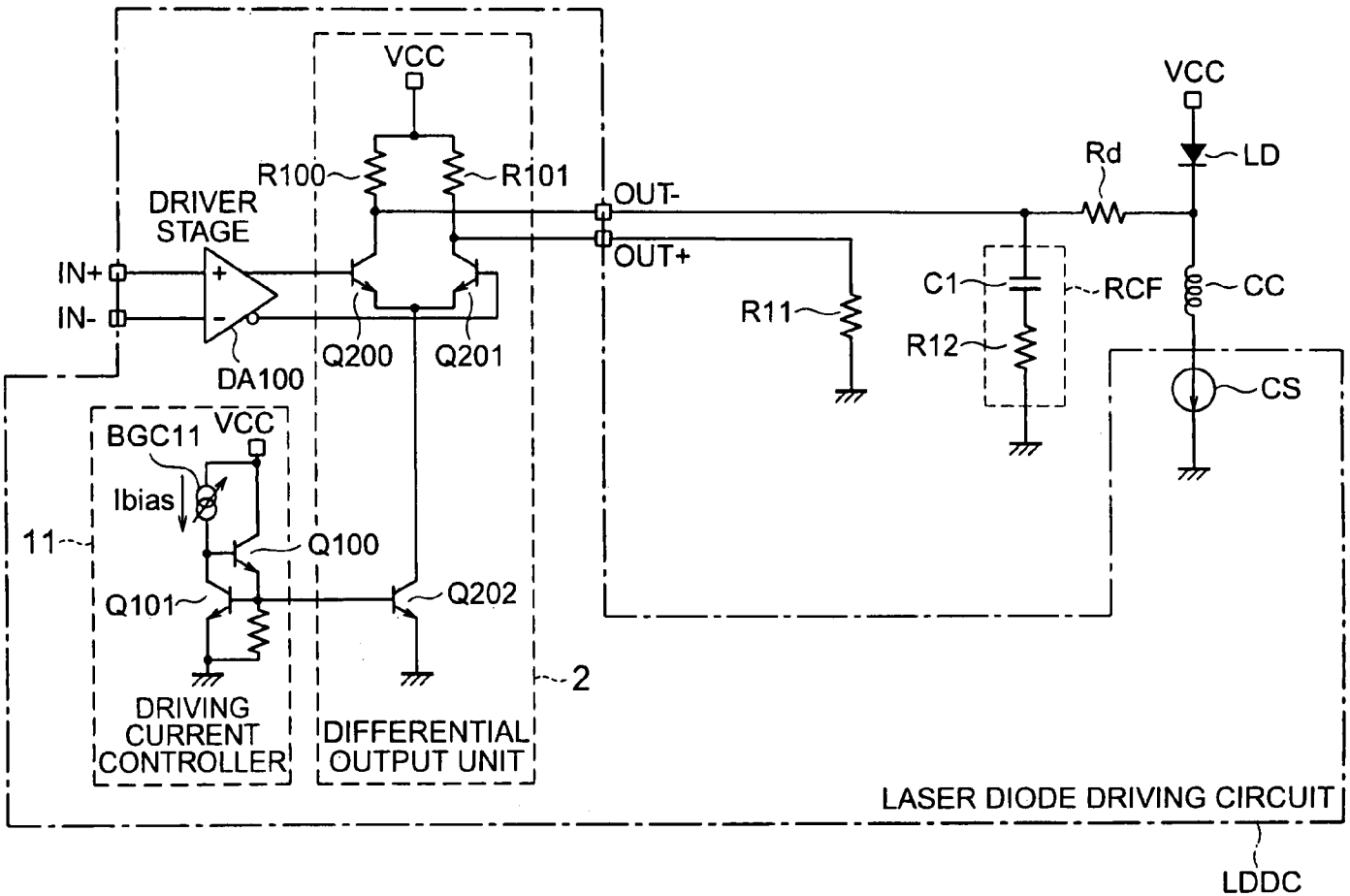
FIG. 2 is a circuit diagram showing the arrangements of a laser diode driving circuit including the bias current generating circuit according to the same embodiment and an optical communication transmitter.

Also, as shown in FIG. 2, a laser diode driving circuit LDDC according to the embodiment of the present invention comprises a driving current controller 11 including a bias current generating circuit BGC11 shown in FIG. 1, a driver stage DA100, a differential output unit 2, and a current source CS.

In addition, as shown in FIG. 2, an optical communication transmitter according to the embodiment of the present invention comprises the laser diode driving circuit LDDC according to this embodiment, and a laser diode LD. This optical communication transmitter further comprises an RC filter RCF which includes a resistor R11, capacitor C1, and resistor R12 to suppress waveform distortion, a resistor Rd, and a choke coil CC.

Figure 6:
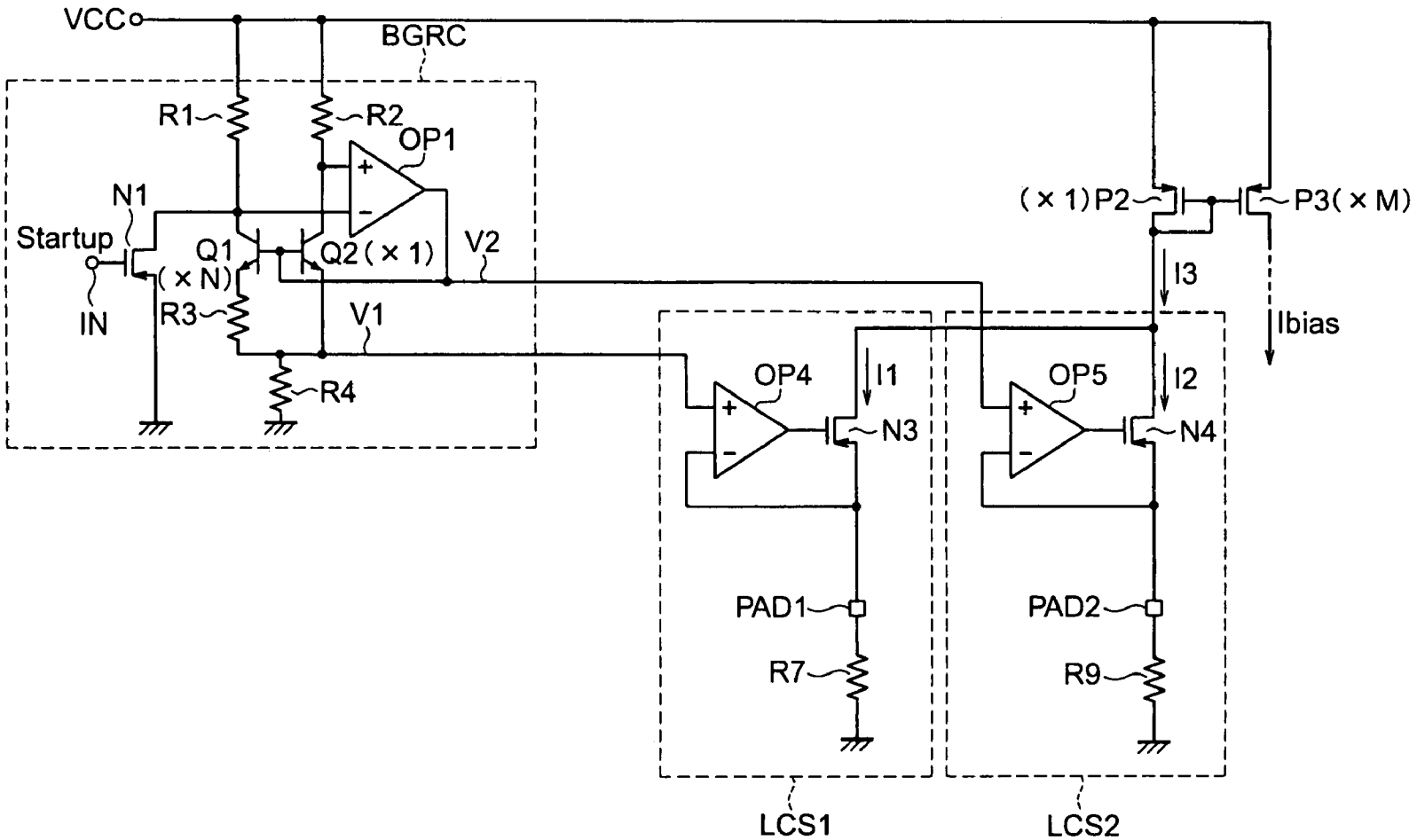
FIG. 6 PRIOR ART
FIG. 6 is a circuit diagram showing the arrangement of a conventional bias current generating circuit.
Figure 7:
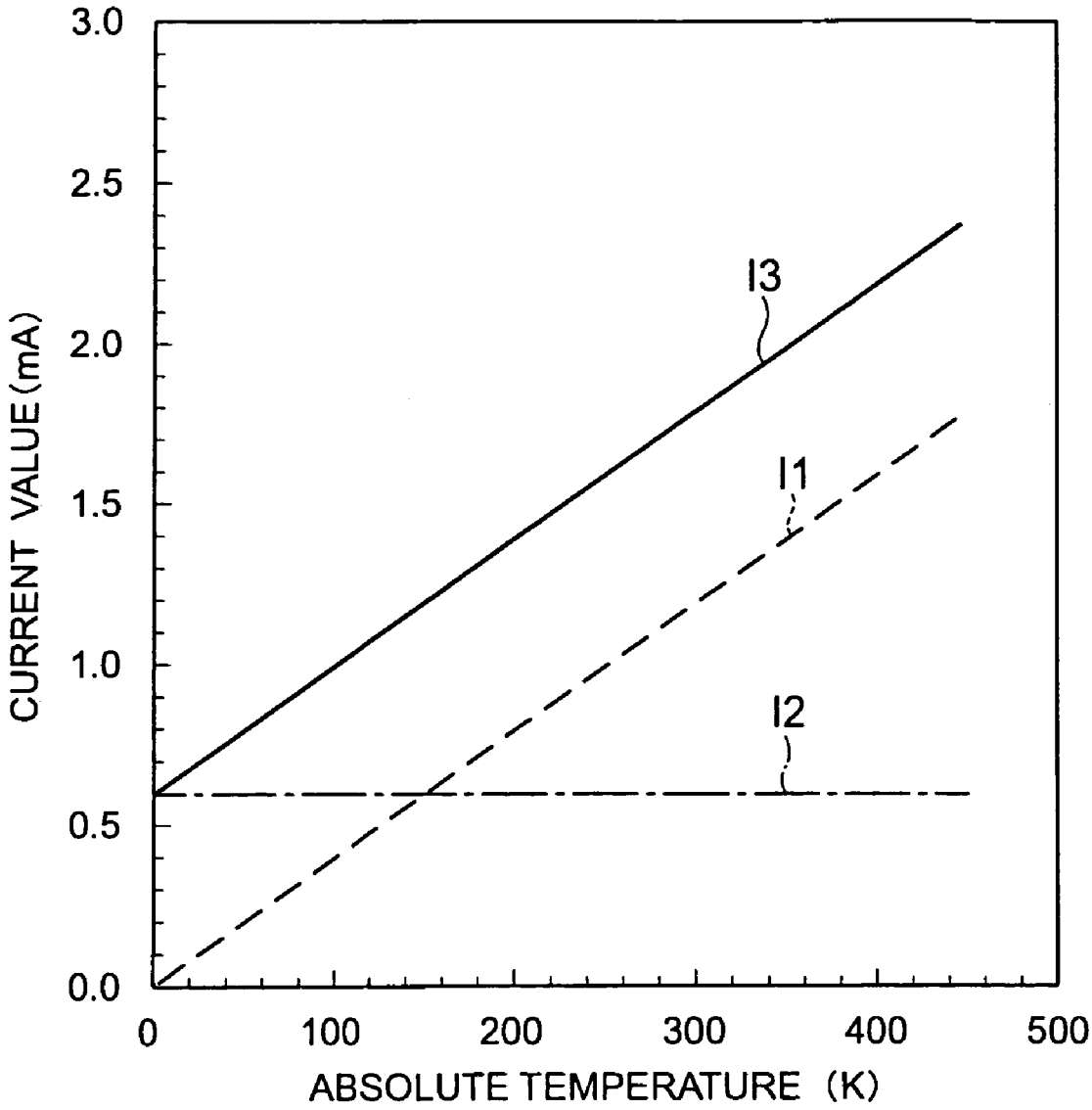
FIG. 7 PRIOR ART
FIG. 7 is a graph showing the dependence of a bias current upon absolute temperature in the bias current generating circuit shown in FIG. 6.

The bias current generating circuit of this embodiment shown in FIG. 1 is obtained by adding a low-potential-side current source circuit LCS3 and high-potential-side current source circuit HCS1 to the arrangement of the conventional bias current generating circuit shown in FIG. 6. In this embodiment, the same reference numerals as in the conventional circuit denote the same elements, and a detailed description thereof will be omitted.

The low-potential-side current source circuit LCS3 has an operational amplifier OP2, NMOS transistor N2, and resistor R5. The non-inverting input terminal of the operational amplifier OP2 receives, as a reference potential, a potential V2 output from the output terminal of an operational amplifier OP1 included in a bandgap reference circuit BGRC. The NMOS transistor N2 has a drain connected to one terminal of a resistor R6, a source connected to the inverting input terminal of the operational amplifier OP2, and a gate connected to the output terminal of the operational amplifier OP2. The resistor R5 is connected between the source of the transistor N2 and the ground terminal.

The low-potential-side current source circuit LCS3 described above and the resistor R6 having one end connected to the drain of the transistor N2 and the other end connected to a power supply voltage Vcc terminal form a voltage shift circuit VSC. The voltage shift circuit VSC shifts the voltage V2 to a desired level and inputs the shifted voltage as a reference voltage V3 to the non-inverting input terminal of an operational amplifier OP3.

The low-potential-side current source circuit LCS3 is given the temperature-independent potential V2 as a reference potential. Letting Ix denote an electric current which flows through the resistor R6, transistor N2, and resistor R5 and is independent of the temperature, the electric current Ix is represented by $$Ix=V2/R5 \tag{4}$$

and the potential V3 is represented by $$V3=Vcc-R6\cdot Ix=Vcc-(R6/R5)\cdot V2 \tag{5}$$

The high-potential-side current source circuit HCS1 has a resistor R8 connected between the power supply voltage Vcc terminal and an external terminal PAD3, the operational amplifier OP3 having an inverting input terminal connected to the external terminal PAD3 and a non-inverting input terminal connected to the drain of the transistor N2, and a PMOS transistor P1 having a source connected to the external terminal PAD3, a gate connected to the output terminal of the operational amplifier OP3, and a drain connected to the drain of a transistor N3 of a low-potential-side current source circuit LCS1.

Since the temperature-independent reference voltage V3 is supplied to the high-potential-side current source circuit HCS1, a temperature-independent electric current 14 flows through the transistor P1. The value of the electric current 14 is adjusted by the resistance value of the resistor R8.

This embodiment having the above arrangement operates as follows in accordance with the presence/absence of the external resistors R7, R8, and R9.

(1) When the resistance values of the resistors R7 and R8 are infinite and that of the resistor R9 is finite, the bias current Ibias maintains a constant value regardless of the temperature.

(2) When the resistance value of the resistor R8 is infinite and those of the resistors R7 and R9 are finite, the bias current Ibias has a finite value at absolute zero and linearly increases with respect to the temperature.

(3) When the resistance values of the resistors R8 and R9 are infinite and that of the resistor R7 is finite, the bias current Ibias is zero at absolute zero and proportional to the temperature.

(4) When the resistance value of the resistor R9 is infinite and those of the resistors R7 and R8 are finite, the bias current Ibias maintains zero up to a certain finite temperature Tth and linearly increases above the temperature Tth.

The characteristics (1) to (3) are similar to those of the circuit shown in FIG. 6, but this embodiment additionally has the characteristic (4) described above. A graph of FIG. 3 shows the characteristic (4).

Figure 3:
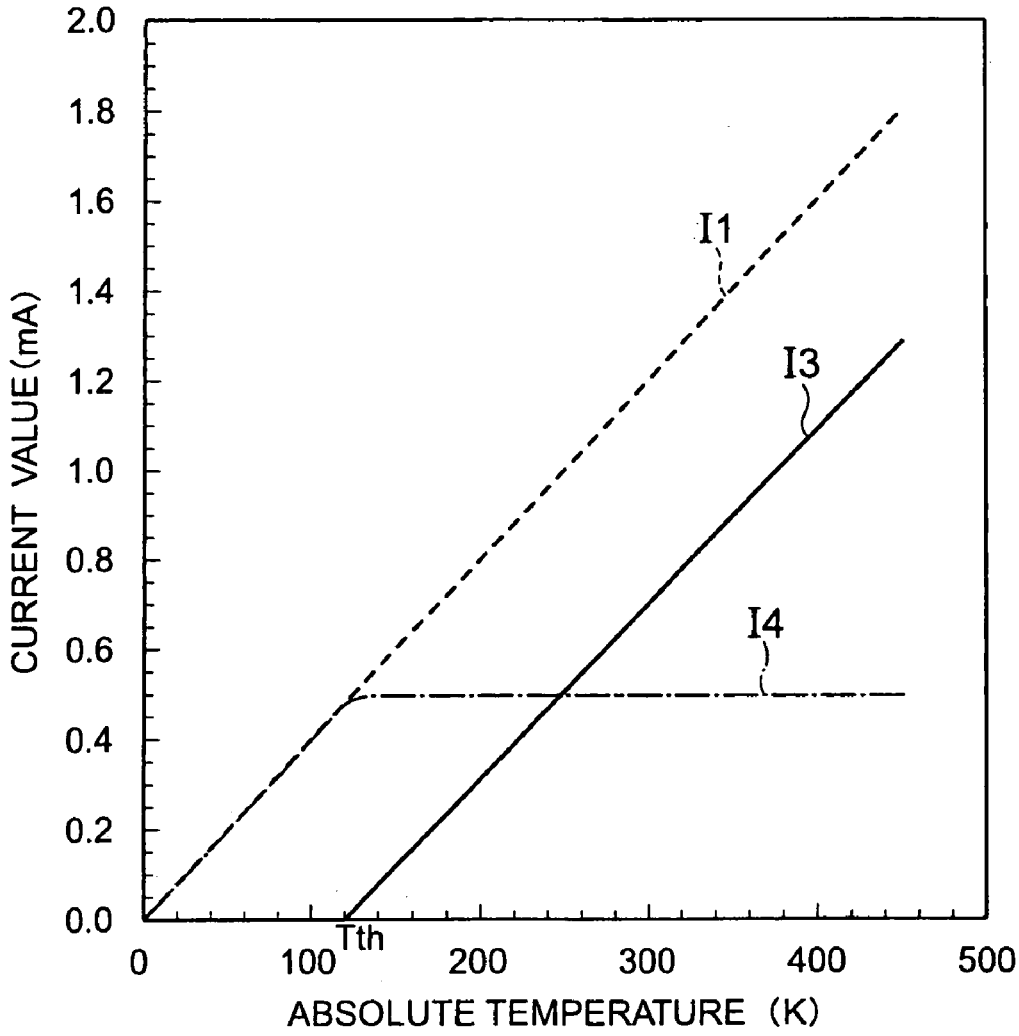
FIG. 3 is a graph showing the dependence of a bias current upon absolute temperature in the bias current generating circuit shown in FIG. 1.

As shown in FIG. 3, the electric current 13 flowing through a transistor P2 as a mirror source of the bias current Ibias is zero until Tth (about 120K) and linearly increases above the temperature Tth.

At temperatures lower than the certain temperature Tth, the high-potential-side current source circuit HCS1 for generating the electric current 14 does not function as a constant-current source and can supply only the same value as the electric current 11. Therefore, the electric current 13 cannot be a negative electric current.

To raise the temperature Tth as a threshold value, the value of the resistance ratio R8/R7 need only be decreased.

A rate R of increase of the bias current Ibias per degree of the temperature at a certain temperature T0 is represented by $$R=1/(T0-T\text{th}) \quad (6)$$

Accordingly, the change in bias current Ibias with temperature can be essentially unlimitedly increased by approaching the temperature Tth to T0.

In this embodiment as described above, the temperature Tth can be freely set by the values of the externally connected resistors R7 and R8. Therefore, temperature compensation can be well performed even for a laser diode whose emission efficiency largely depends upon the temperature.

That is, the optical output power amplitude can be maintained constant regardless of the temperature even for a laser diode whose emission efficiency largely depends upon the temperature.

The above embodiment is merely an example and hence does not limit the present invention. Therefore, the embodiment can be variously modified within the spirit and scope of the present invention.

Figure 4:
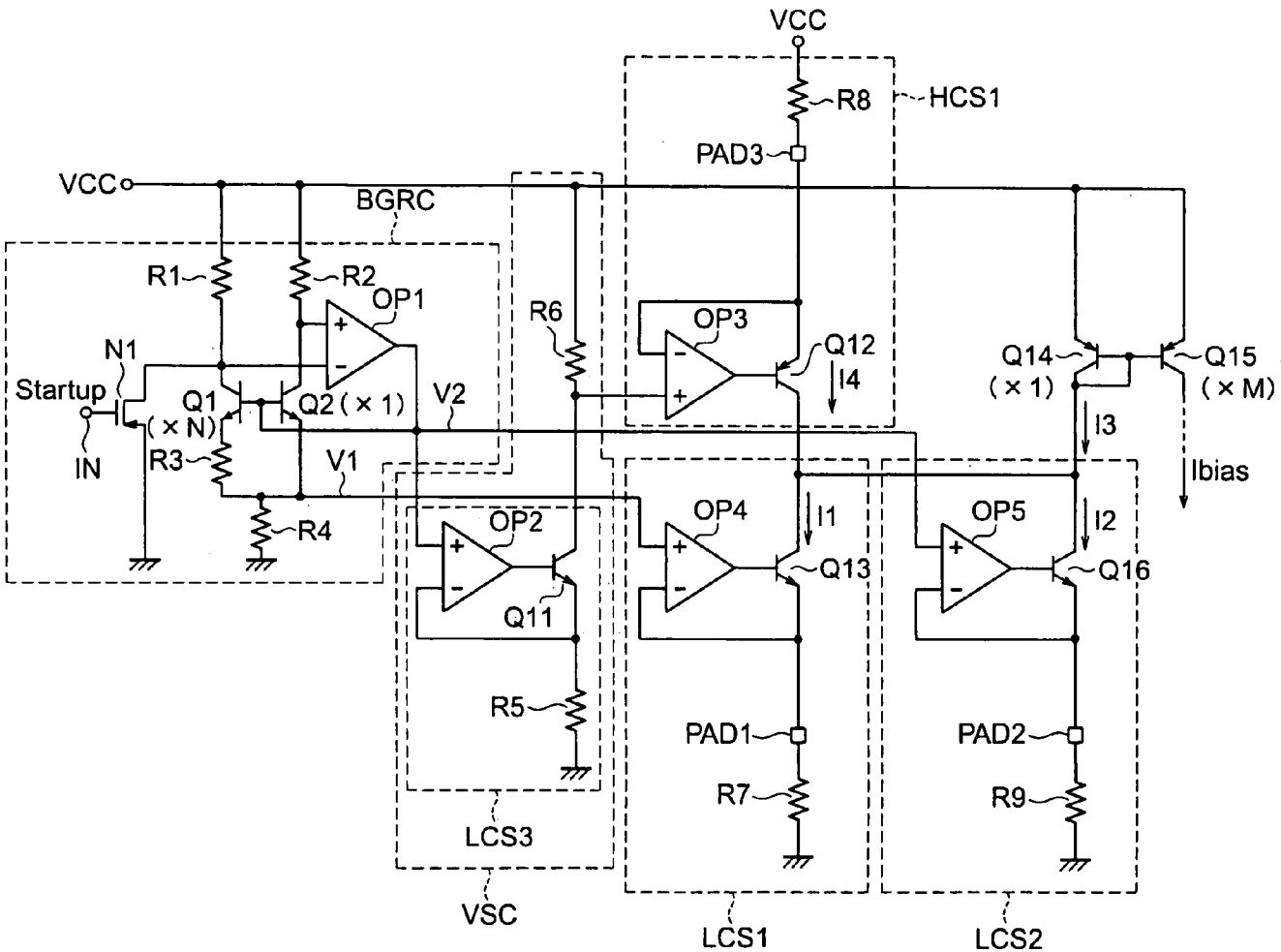
FIG. 4 is a circuit diagram showing an arrangement in which MOS transistors shown in FIG. 1 are replaced with bipolar transistors.
Figure 5:
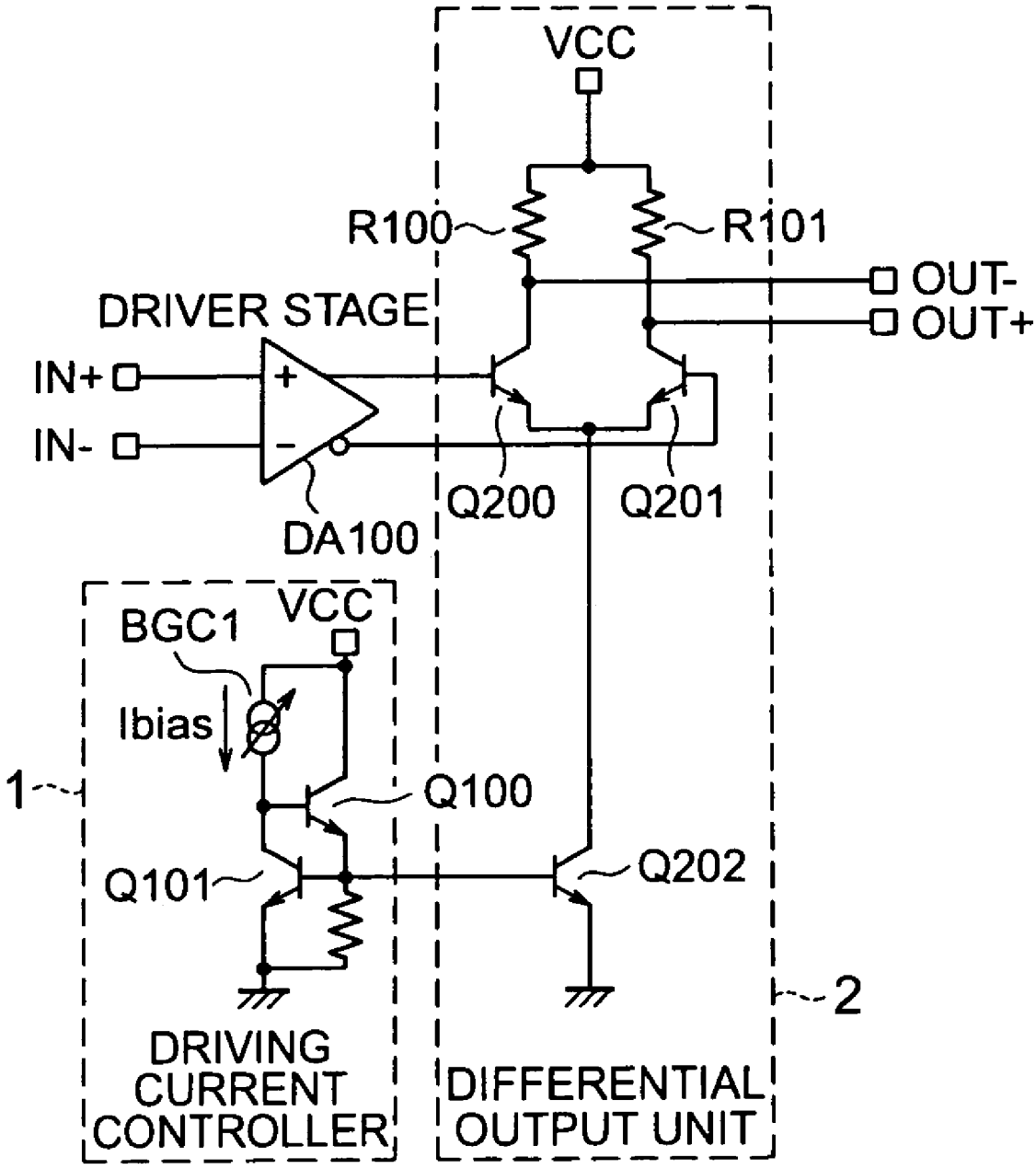
FIG. 5 is a circuit diagram showing the arrangement of a laser diode driving circuit capable of using the bias current generating circuit of the present invention.

For example, in the above embodiment, transistors except for the two NPN bipolar transistors Q1 and Q2 included in the bandgap reference circuit BGRC are MOSFETs. However, as shown in FIG. 4, it is also possible to use NPN bipolar transistors instead of NMOS transistors, and PNP bipolar transistors instead of PMOS transistors.

Also, the current mirror circuit made up of the PMOS transistors P2 and P3 can be replaced with another circuit which performs a current mirror operation with higher accuracy. Furthermore, the bandgap reference circuit BGRC can have another arrangement instead of the circuit configurations shown in FIGS. 1, 2, and 4.

As has been described above, in the bias current generating circuit according to the embodiment of the present invention, a first current supply terminal for supplying a first electric current dependent on the temperature and corresponding to a first resistor, a second current supply terminal for supplying a second electric current independent of the temperature and corresponding to a second resistor, and a third current supply terminal for supplying a third electric current independent of the temperature and corresponding to a third resistor are connected to the reference current terminal of the current mirror circuit, and a bias current is generated in accordance with an electric current supplied to this reference current terminal.

Also, the laser diode driving circuit and optical communication transmitter according to the embodiment of the present invention can well perform temperature compensation by supplying the bias current as described above to a laser diode, even when the temperature dependence of the emission efficiency of the laser diode is large, and can hold the optical output power amplitude constant regardless of the temperature.

What is claimed is:

1. A bias current generating circuit comprising:

a bandgap reference circuit connected to a high power supply voltage terminal for receiving a high power supply voltage and a low power supply voltage terminal for receiving a low power supply voltage, and having a first output terminal for outputting a first voltage which is constant regardless of a temperature, and a second output terminal for outputting a second voltage which changes in accordance with a temperature;

a first low-potential-side constant-current source circuit which includes a first resistor connected between said low power supply voltage terminal and a first terminal, and a first current path connected between said first terminal and a first current supply terminal, receives the second voltage as a reference potential, and outputs a first electric current dependent on a temperature and corresponding to said first resistor from said first current supply terminal;

a second low-potential-side constant-current source circuit which includes a second resistor connected between said low power supply voltage terminal and a second terminal, and a second current path connected between said second terminal and a second current supply terminal, receives the first voltage as a reference potential, and outputs a second electric current independent of a temperature and corresponding to said second resistor from said second current supply terminal;

a third resistor having one end connected to said high power supply voltage terminal;

a third low-potential-side constant-current source circuit which is connected between the other end of said third resistor and said low power supply voltage terminal, receives the first voltage as a reference potential, and supplies a temperature-independent third electric current to said third resistor;

a high-potential-side constant-current source circuit which includes a fourth resistor connected between said high power supply voltage terminal and a third terminal, and a third current path connected between said third terminal and a third current supply terminal, receives a third voltage at the other end of said third resistor as a reference potential, and outputs a fourth electric current independent of a temperature and corresponding to said fourth resistor from said third current supply terminal; and a current mirror circuit which is connected to said high power supply voltage terminal to receive the high power supply voltage, and generates a bias current in accordance with an electric current supplied from a reference current terminal, wherein said first, second, and third current supply terminals are connected to said reference current terminal.

2. A circuit according to claim 1, wherein said first low-potential-side constant-current source circuit comprises:

a first operational amplifier having a non-inverting input terminal connected to said second output terminal, and an inverting input terminal connected to said first terminal; and a first NMOS transistor having a drain connected to said first current supply terminal, a gate connected to an output terminal of said first operational amplifier, and a source connected to said first terminal, said second low-potential-side constant-current source circuit comprises:

a second operational amplifier having a non-inverting input terminal connected to said first output terminal, and an inverting input terminal connected to said second terminal; and a second NMOS transistor having a drain connected to said second current supply terminal, a gate connected to an output terminal of said second operational amplifier, and a source connected to said second terminal, and said high-potential-side constant-current source circuit comprises:

a third operational amplifier having a non-inverting input terminal connected to said third terminal, and an inverting input terminal connected to the other end of said third resistor; and a first PMOS transistor having a source connected to said third terminal, a gate connected to an output terminal of said third operational amplifier, and a drain connected to said third current supply terminal.

3. A circuit according to claim 2, wherein said third low-potential-side constant-current source circuit comprises:

a fourth operational amplifier having a non-inverting input terminal connected to said first output terminal;

a third NMOS transistor having a drain connected to the other end of said third resistor, and a gate connected to an output terminal of said fourth operational amplifier; and a fifth resistor having one end connected to an inverting input terminal of said fourth operational amplifier and a source of said third NMOS transistor, and the other end connected to said low power supply voltage terminal, and said current mirror circuit comprises:

a second PMOS transistor having a source connected to said high power supply voltage terminal, and a gate and drain connected to said reference current terminal; and a third PMOS transistor having a source connected to said high power supply voltage terminal, and a gate connected to said reference current terminal, said third PMOS transistor outputting the bias current from the source thereof.

4. A circuit according to claim 2, wherein each of said first, second, and fourth resistors is one of a fixed resistor, variable resistor, and electronic volume IC.

5. A circuit according to claim 1, wherein said first low-potential-side constant-current source circuit comprises:

a first operational amplifier having a non-inverting input terminal connected to said second output terminal, and an inverting input terminal connected to said first terminal; and a first NPN bipolar transistor having a collector connected to said first current supply terminal, a base connected to an output terminal of said first operational amplifier, and an emitter connected to said first terminal, said second low-potential-side constant-current source circuit comprises:

a second operational amplifier having a non-inverting input terminal connected to said first output terminal, and an inverting input terminal connected to said second terminal; and a second NPN bipolar transistor having a collector connected to said second current supply terminal, a base connected to an output terminal of said second operational amplifier, and an emitter connected to said second terminal, and said high-potential-side constant-current source circuit comprises:

a third operational amplifier having a non-inverting input terminal connected to said third terminal, and an inverting input terminal connected to the other end of said third resistor; and a first PNP bipolar transistor having an emitter connected to said third terminal, a base connected to an output terminal of said third operational amplifier, and a collector connected to said third current supply terminal.

6. A circuit according to claim 5, wherein said third low-potential-side constant-current source circuit comprises:

a fourth operational amplifier having a non-inverting input terminal connected to said first output terminal;

a third NPN bipolar transistor having a collector connected to the other end of said third resistor, and a base connected to an output terminal of said fourth operational amplifier; and a fifth resistor having one end connected to an inverting input terminal of said fourth operational amplifier and an emitter of said third NPN bipolar transistor, and the other end connected to said low power supply voltage terminal, and said current mirror circuit comprises:

a second PNP bipolar transistor having a source connected to said high power supply voltage terminal, and a gate and drain connected to said reference current terminal; and a third PNP bipolar transistor having a source connected to said high power supply voltage terminal, and a gate connected to said reference current terminal, said third PNP bipolar outputting the bias current from the source thereof.

7. A circuit according to claim 5, wherein each of said first, second, and fourth resistors is one of a fixed resistor, variable resistor, and electronic volume IC.

8. A circuit according to claim 1, wherein said third low-potential-side constant-current source circuit comprises:

a fourth operational amplifier having a non-inverting input terminal connected to said first output terminal;

a third NMOS transistor having a drain connected to the other end of said third resistor, and a gate connected to an output terminal of said fourth operational amplifier; and a fifth resistor having one end connected to an inverting input terminal of said fourth operational amplifier and a source of said third NMOS transistor, and the other end connected to said low power supply voltage terminal, and said current mirror circuit comprises:

a second PMOS transistor having a source connected to said high power supply voltage terminal, and a gate and drain connected to said reference current terminal; and a third PMOS transistor having a source connected to said high power supply voltage terminal, and a gate connected to said reference current terminal, said third PMOS transistor outputting the bias current from the source thereof.

9. A circuit according to claim 8, wherein each of said first, second, and fourth resistors is one of a fixed resistor, variable resistor, and electronic volume IC.

10. A circuit according to claim 1, wherein said third low-potential-side constant-current source circuit comprises:

a fourth operational amplifier having a non-inverting input terminal connected to said first output terminal;

a third NPN bipolar transistor having a collector connected to the other end of said third resistor, and a base connected to an output terminal of said fourth operational amplifier; and a fifth resistor having one end connected to an inverting input terminal of said fourth operational amplifier and an emitter of said third NPN bipolar transistor, and the other end connected to said low power supply voltage terminal, and said current mirror circuit comprises:

a second PNP bipolar transistor having a source connected to said high power supply voltage terminal, and a gate and drain connected to said reference current terminal; and a third PNP bipolar transistor having a source connected to said high power supply voltage terminal, and a gate connected to said reference current terminal, said third PNP bipolar outputting the bias current from the source thereof.

11. A circuit according to claim 10, wherein each of said first, second, and fourth resistors is one of a fixed resistor, variable resistor, and electronic volume IC.

12. A circuit according to claim 1, wherein each of said first, second, and fourth resistors is one of a fixed resistor, variable resistor, and electronic volume IC.

13. A laser diode driving circuit comprising:

a sixth resistor having one end connected to said high power supply voltage terminal;

a fourth NPN bipolar transistor having a collector connected to the other end of said sixth resistor, and a base which receives one differential input signal;

a seventh resistor having one end connected to said high power supply voltage terminal;

a fifth NPN bipolar transistor having a collector connected to the other end of said seventh resistor, and a base which receives the other differential input signal;

a sixth NPN bipolar transistor having a collector connected to emitters of said fourth and fifth NPN bipolar transistors, a base connected to a current input terminal, and an emitter which is grounded either directly or via an eighth resistor;

a differential output unit which performs differential amplification by receiving the differential output signals, and generates a driving current signal for driving a laser diode from the collector of at least one of said fourth and fifth NPN bipolar transistors;

said bias current generating circuit cited in claim 1; and a driving current controller which receives the bias current generated by said bias current generating circuit, amplifies the received bias current, and supplies the amplified bias current to the current input terminal of said differential output unit.

14. An optical communication transmitter comprising:

said laser diode driving circuit cited in claim 13; and a laser diode which receives the driving current signal generated by said laser diode driving circuit.

15. A laser diode driving circuit comprising:

a sixth resistor having one end connected to said high power supply voltage terminal;

a fourth NPN bipolar transistor having a collector connected to the other end of said sixth resistor, and a base which receives one differential input signal;

a seventh resistor having one end connected to said high power supply voltage terminal;

a fifth NPN bipolar transistor having a collector connected to the other end of said seventh resistor, and a base which receives the other differential input signal;

a sixth NPN bipolar transistor having a collector connected to emitters of said fourth and fifth NPN bipolar transistors, a base connected to a current input terminal, and an emitter which is grounded either directly or via an eighth resistor;

a differential output unit which performs differential amplification by receiving the differential output signals, and generates a driving current signal for driving a laser diode from the collector of at least one of said fourth and fifth NPN bipolar transistors;

said bias current generating circuit cited in claim 2; and a driving current controller which receives the bias current generated by said bias current generating circuit, amplifies the received bias current, and supplies the amplified bias current to the current input terminal of said differential output unit.

16. An optical communication transmitter comprising:

said laser diode driving circuit cited in claim 15; and a laser diode which receives the driving current signal generated by said laser diode driving circuit.

* * * * *